US007594768B2

(12) United States Patent
Takada et al.

(10) Patent No.: US 7,594,768 B2
(45) Date of Patent: Sep. 29, 2009

(54) TAPE PROCESSING APPARATUS, METHOD OF CONDUCTING DEMONSTRATION WITH TAPE PROCESSING APPARATUS, AND PROGRAM

(75) Inventors: Makoto Takada, Nagano-ken (JP); Seiji Tanaka, Azumino (JP); Takayuki Uehara, Koshigaya (JP)

(73) Assignees: Seiko Epson Corporation, Tokyo (JP); King Jim Co., Ltd., Tokyo (JP)

( * ) Notice: Subject to any disclaimer, the term of this patent is extended or adjusted under 35 U.S.C. 154(b) by 603 days.

(21) Appl. No.: 11/397,509

(22) Filed: Apr. 3, 2006

(65) Prior Publication Data

US 2006/0228145 A1 Oct. 12, 2006

(30) Foreign Application Priority Data

Apr. 6, 2005 (JP) ..... 2005-110385

(51) Int. Cl.
*B41J 3/32* (2006.01)

(52) U.S. Cl. ..... 400/109.1; 400/76

(58) Field of Classification Search ..... 400/109.1
See application file for complete search history.

(56) References Cited

U.S. PATENT DOCUMENTS 5,447,378 A * 9/1995 Otsuka et al. ..... 400/61
5,961,232 A * 10/1999 Watanabe et al. ..... 400/615.2
2004/0190965 A1* 9/2004 Tanaka et al. ..... 400/61

FOREIGN PATENT DOCUMENTS

JP 08-183212 7/1996
JP 10-000818 1/1998
JP 2001-088358 4/2001

* cited by examiner

*Primary Examiner*—Daniel J Colilla
(74) *Attorney, Agent, or Firm*—Hogan & Hartson LLP

(57) ABSTRACT

There is provided a tape processing apparatus arranged to perform an ink-character printing and a braille embossing on a process tape, the apparatus including: a first demonstration device which performs a first demonstration process based on first demonstration data for demonstration of the ink-character printing; a second demonstration device which performs a second demonstration process based on second demonstration data for demonstration of the braille embossing; and a demonstration switching device which selectively switches between the first demonstration process and the second demonstration process.

4 Claims, 7 Drawing Sheets

TAPE PROCESSING APPARATUS, METHOD OF CONDUCTING DEMONSTRATION WITH TAPE PROCESSING APPARATUS, AND PROGRAM

The entire disclosure of Japanese Patent Application No. 2005-110385, filed Apr. 6, 2005, is expressly incorporated by reference herein.

BACKGROUND

1. Technical Field

The present invention relates to a tape processing apparatus which performs an ink-character printing and a braille embossing on a process sheet, a method of conducting a demonstration with a tape processing apparatus, and a program.

2. Related Art

A known label forming apparatus is, for example, of a type which prints arbitrary information in ink on a process tape to form a label. Reference is made to JP-A-10-00818 as an example of related art. As a label forming apparatus of this kind, a typical one has a demonstration printing function which conducts a demonstration for a printing process as often performed in stores or the like. On the other hand, a known braille label forming apparatus is of a type which performs an ink-character printing process and a braille embossing process at the same time and forms a braille label recognizable by both visually impaired and visually normal persons. Reference is made to JP-A-2001-88358 as an example of related art.

Meanwhile, affixing braille labels providing visually impaired persons with various information is becoming increasingly common in public facilities such as vending machines, elevators, and ATMs (Automatic Teller Machines) of banks. In other words, users in need of this type of a braille label forming apparatus increase. In such a situation, some users desire to grasp, before or immediately after purchasing the apparatus, the image of the product formed by the braille label forming apparatus and the operating state such as the processing speed. As far as an ink-character printing process is concerned, it is possible to satisfy such a desire just by installing the foregoing demonstration printing function on the braille label forming apparatus. On the other hand, however, it is not possible to adapt to the users, desire with respect to a braille embossing process.

SUMMARY

It is an advantage of the invention to provide a tape processing apparatus having a function which allows the user to easily grasp the contents of the image of the product where braille characters are embossed and the operating state of a braille embossing process, a method of conducting a demonstration with a tape processing apparatus, and a program.

According to one aspect of the invention, there is provided a tape processing apparatus arranged to perform an ink-character printing and a braille embossing on a process tape. The apparatus comprises: a first demonstration device which performs a first demonstration process based on first demonstration data for demonstration of the ink-character printing; a second demonstration device which performs a second demonstration process based on second demonstration data for demonstration of the braille embossing; and a demonstration switching device which selectively switches between the first demonstration process and the second demonstration process.

According to another aspect of the invention, there is provided a method of conducting a demonstration with a tape processing apparatus on which an ink-character-dedicated tape for an ink-character printing and an ink-character/braille-character tape adapted for the ink-character printing and a braille embossing are selectively mounted and which is arranged to perform the ink-character printing and the braille embossing. The method comprises: performing a first demonstration process for demonstration of the ink-character printing on the ink-character-dedicated tape when the ink-character-dedicated tape is mounted; and performing a second demonstration process for demonstration of the braille embossing on the ink-character/braille-character tape when the ink-character/braille-character tape is mounted.

According to these configurations, two types of demonstration processes, i.e., one for an ink-character printing process and the other for a braille embossing process can be performed. Furthermore, since the two types of demonstration processes can selectively be switched, a demonstration process which suits the user's need can be performed. In other words, it is made possible that the demonstration function is used in stores or the like to reinforce sales promotion, or the user unaccustomed to an apparatus performs the demonstration processes to grasp the overview of respective functions which the apparatus has.

In this case, it is preferable that an ink-character-dedicated tape for the ink-character printing and an ink-character/braille-character tape adapted for the ink-character printing and the braille embossing be provided as a process tape, both being detachably mounted on the tape processing apparatus while accommodated in a cartridge, the tape processing apparatus further comprising a tape-type detecting device which detects a type of the mounted process tape through the cartridge, the demonstration switching device switching between the first demonstration process and the second demonstration process based on a detection result by the tape-type detecting device.

According to this configuration, since the tape processing apparatus detects the type of a mounted process tape and then performs the first demonstration process which conducts a demonstration for an ink-character printing or the second demonstration process which conducts a demonstration for a braille embossing based on the detection result, the user is allowed to save labor of selecting the type of the demonstration process to be performed. In other words, it is made possible for the user to perform by a common operation the first and second demonstration processes without having an awareness about the type of the demonstration process to be performed. Furthermore, it is possible to previously prevent the user from erroneously performing the first demonstration process for an ink-character printing on an ink-character/braille-character tape or the second demonstration process for a braille embossing on an ink-character-dedicated tape. Note that an ink-character/braille-character tape is expensive since it is composed of a tape material corresponding to a physical processing, i.e., a braille embossing. Therefore, in terms of an economical view point, it is not preferable that the user employ an ink-character/braille-character tape as an ink-character-dedicated tape.

In these cases, it is preferable that the second demonstration data contain braille string data of a braille string composed of a plurality of braille characters as braille embossing data, as well as ink-character translation data converted from the braille string as ink-character printing data.

According to this configuration, it is possible even for the user who has little knowledge about braille to easily grasp the contents of the braille characters embossed in the second demonstration process through the ink-character printing data printed in ink characters in the second demonstration process.

In this case, it is preferable that the tape processing apparatus further comprise: an ink-character testing device which performs a test printing for the ink-character printing; a braille testing device which performs a test embossing for the braille embossing; and a test switching device which selectively switches between the test printing and the test embossing.

According to this configuration, the tape processing apparatus makes it possible to further perform a test printing and a test embossing for confirming whether or not an ink-character printing process and a braille embossing process normally operate.

According to still another aspect of the invention, there is provided a program which causes a computer to function as each of the devices of the tape processing apparatus described in any one of the above.

According to this configuration, it is made possible to provide a program which allows the user to easily grasp the contents of the image of the product where braille characters are embossed and an operating state of a braille embossing process.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, referring to the accompanying drawings, description will be made about a case in which a tape processing apparatus according to an embodiment of the invention is applied to a label forming apparatus. The label forming apparatus has an ink-character printing section and a braille embossing section. The ink-character printing section performs an ink-character printing on a process sheet, and the printed part of the process sheet is cut into a tape piece. The tape piece is then manually inserted into the braille embossing section and embossed in braille therein.

Figure 1:
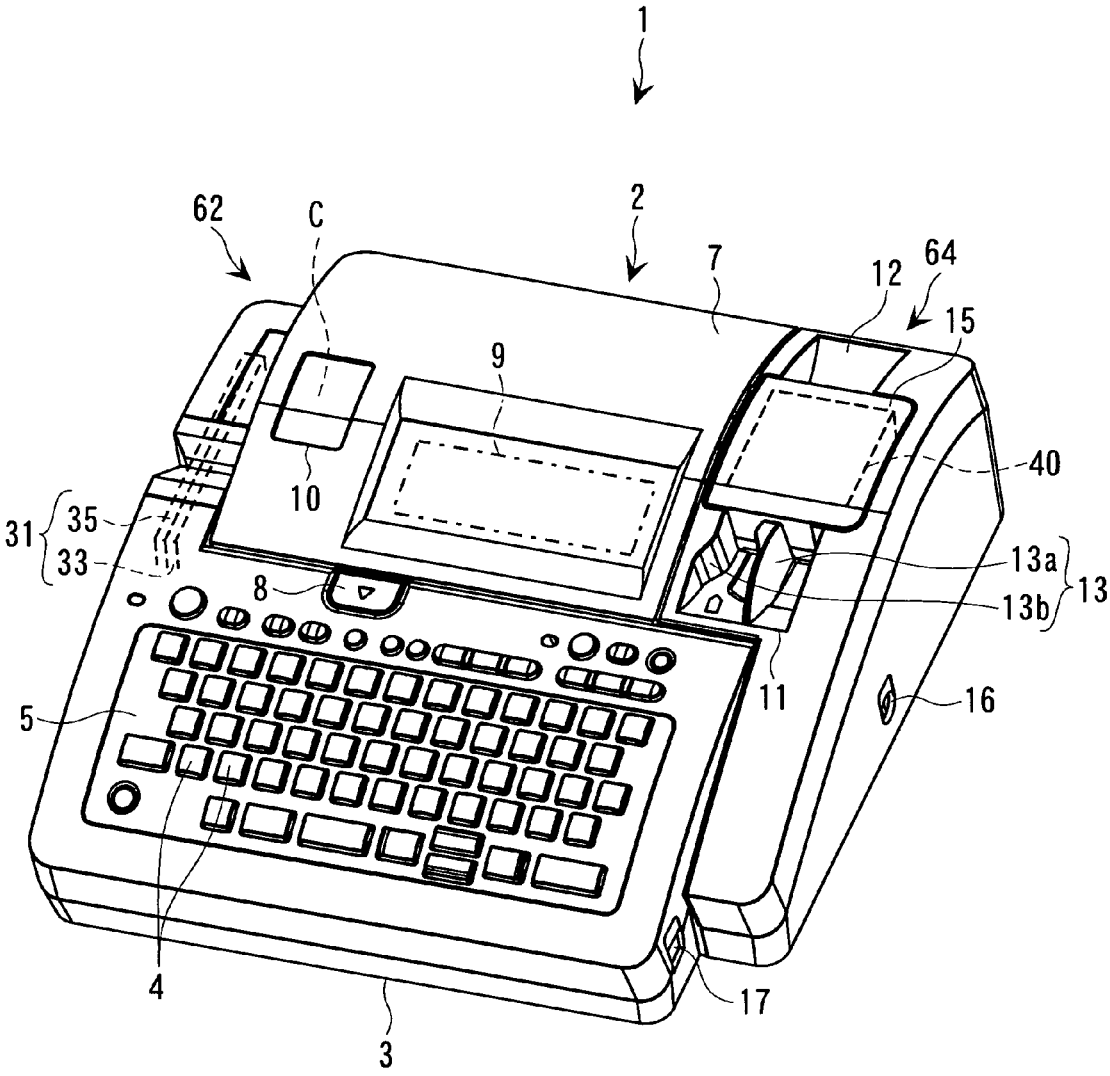
FIG. 1 shows an external perspective view of a label forming apparatus with its cover closed.
Figure 2:
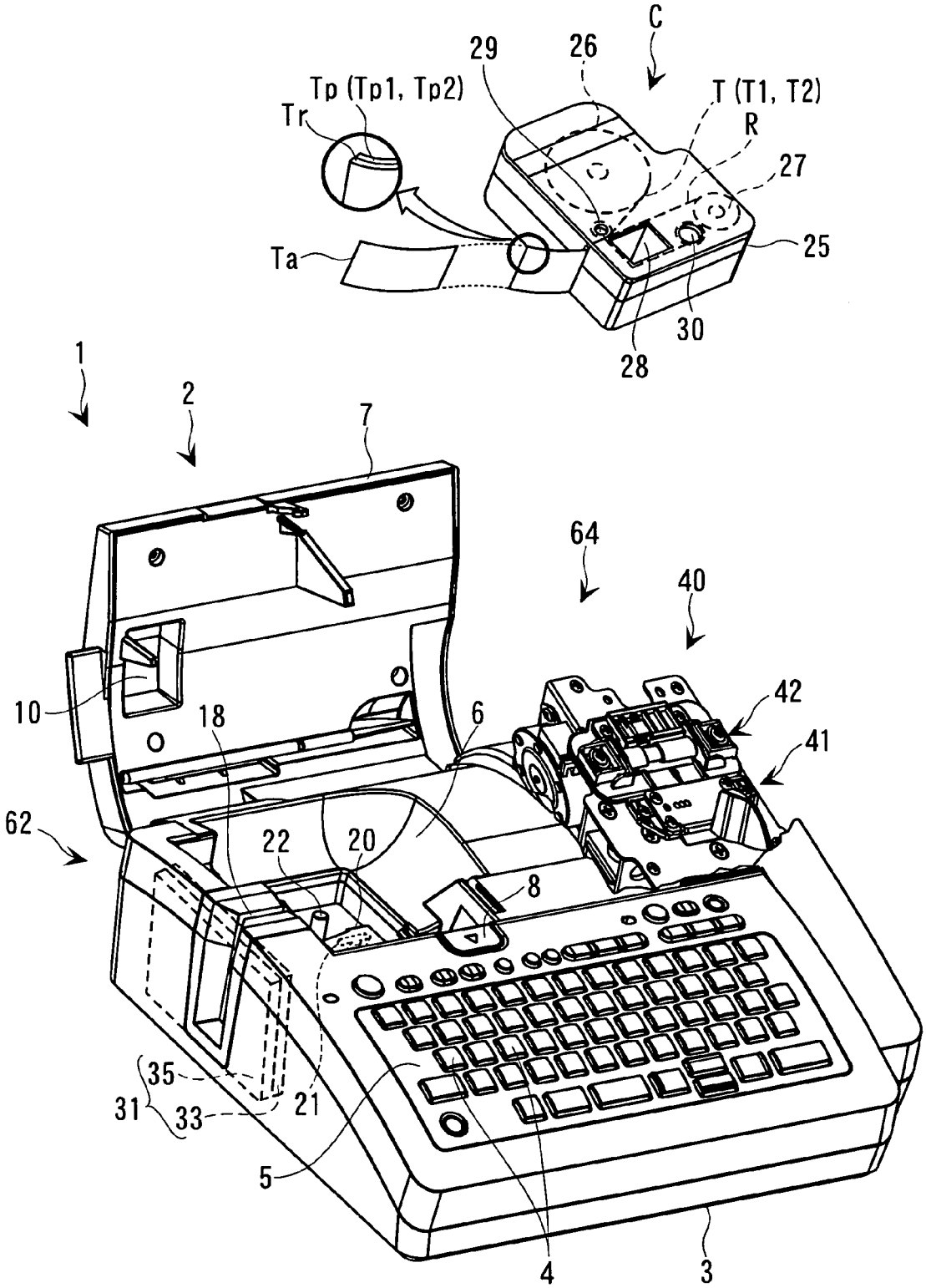
FIG. 2 shows an external perspective view of the label forming apparatus with its cover opened.

FIGS. 1 and 2 show external perspective views of the label forming apparatus with its cover closed and opened, respectively. As shown in FIGS. 1 and 2, the label forming apparatus 1 has an apparatus main body 2 which prints ink characters on the process tape T (see FIG. 2) and embosses braille characters on the tape piece Ta (see FIG. 2) of the process tape T and a tape cartridge C accommodating the process tape T and an ink ribbon R and detachably attached to the apparatus main body 2.

The apparatus main body 2 has an outer shell formed by an apparatus casing 3 in which the ink-character printing section 62 is widely arranged, and the braille embossing section 64 is arranged at the rear-half area on the right side of the apparatus casing 3. The apparatus casing 3 has a keyboard 5 including various keys 4 disposed at the top surface on the front-half side thereof. At the top surface on the rear-half side of the apparatus casing 3 is widely provided an opening and closing cover 7. On the near side of the opening and closing cover 7 is provided a cover opening button 8 for opening the same. On the front side of the opening and closing cover 7 are provided a rectangular display 9 for displaying results or the like inputted from the keyboard 5.

Inside the opening and closing cover 7 is provided a recessed cartridge mounting section 6 on which the tape cartridge C is mounted. In the cartridge mounting section 6 is disposed a print head 21 which prints ink characters on the process tape T reeled out from the tape cartridge C (see FIG. 2).

On the left side of the apparatus casing 3 is formed a print-tape ejecting slot 18 which communicates the cartridge mounting section 6 with the outside of the apparatus. The apparatus casing 3 includes a cutter unit 31 which cuts off the process tape T, facing on the print-tape ejecting slot 18. The cutter unit 31 is disposed to face on the print-tape ejecting slot 18 and has a full cutter 33 and a half cutter 35. The full cutter 33 is driven by a motor (full-cutter motor 32, see FIG. 4) to cuts off the process tape T like scissors, and the half cutter 35 equipped with a stopper is disposed on the downstream side in the tape-feeding direction relative to the full cutter 33 and driven by a motor (half-cutter motor 34, see FIG. 4) to cut off only the below-described recording tape Tr of the process sheet T like scissors. After this half-cutting operation, the process tape T will have a margin (not shown) formed at the tip-end part thereof in the direction in which the process tape is inserted into the below-described embossing assembly 40.

On the other hand, at the right top-surface on the rear-half side of the apparatus casing 3 is disposed a braille embossing section 64. The braille embossing section 64 has an embossing-tape inserting section (sheet inserting section) 11 into which the tape piece Ta is manually inserted from the front side of the embossing-tape inserting section with its printing surface directed upward and an embossing-tape ejecting section 12 from which the tape piece Ta embossed in braille is ejected backward, between which is interposed an embossing assembly 40 serving as the main body of the braille embossing section 64. The embossing-tape inserting section 11 is provided with a manual inserting guide 13 by which the width for receiving the tape piece can be adjusted. Note that reference numeral 15 in FIG. 1 denotes an embossing-section cover which covers the embossing assembly 40.

On the right side of the apparatus casing 3 are formed a power supply-port 16 which supplies electric power and a connecting port 17 (interface) which connects to external apparatuses such as personal computers. According to this configuration, the external apparatuses can be connected to the connecting port 17, which in turn makes it possible to perform an ink-character printing and a braille embossing based on character information generated by the external apparatuses or the like. Furthermore, although omitted in FIGS. 1 and 2, the apparatus casing 3 has a circuit board constituting a controlling section 60 (see FIG. 4) which comprehensively controls the apparatus casing 2 mounted therein.

The cartridge mounting section 6 has the print head 21 having a heater element and covered with a head cover 20, a positioning boss 22 which positions the below-described tape reel 26, a platen driving shaft (not shown) which feeds the process tape T and the ink ribbon R of the tape cartridge C and placed opposite to the print head 21, and a take-up driving shaft (not shown) which takes up the ink ribbon R, all of which are projectingly provided in the cartridge mounting section. Furthermore, at the corner of the cartridge mounting section 6 is provided a tape discriminating sensor 23 (see FIG. 4) composed of a plurality of micro switches. In a bottom plate of the cartridge mounting section 6 are incorporated a print-feeding motor 24 (see FIG. 4) which drives the platen driving shaft and the take-up driving shaft, a reduction gear train (not shown), or the like.

The tape cartridge C has a cartridge casing 25 in which are accommodated a tape reel 26 winding the process tape T, a ribbon feeding reel 27 winding the ink ribbon R, and a ribbon taking-up reel 30. The ribbon feeding reel 27 and the ribbon taking-up reel 30 are positioned on the right lower side of the cartridge casing. Furthermore, around the left lower side of the tape reel 26 is formed a through-hole 28 into which the head cover 20 covering the print head 21 is inserted. Besides, at a position where the process tape T and the ink ribbon R overlap each other is arranged a platen roller 29 which is engaged with the platen driving shaft and rotates therewith.

When the tape cartridge C is mounted on the cartridge mounting section 6, the head cover 20, the positioning boss 22, the take-up driving shaft, and the platen driving shaft are inserted into the through hole 28, the tape reel 26, the ribbon taking-up reel 30, and the platen roller 29, respectively. When the opening and closing cover 7 is closed in this state, the print head 21 and the platen roller 29 are successively brought into contact with each other and sandwich the process tape T and the ink ribbon R therebetween, to create a printing standby state. Then, the platen driving shaft and the take-up driving shaft cyclically rotate based on ink-characters data generated by the controlling section 60 corresponding to character information inputted from the keyboard 5 or the like, and the print head 21 performs an ink-character printing while the process tape T and the ink ribbon R are fed. At the same time, the ink ribbon R fed out from the ribbon feeding reel 27 travels around walls of the through hole 28 and is taken up by the ribbon taking-up reel 30. On the process tape T printed with ink characters is formed the margin (not shown) by the half cutter 35, and the printed part of the process tape T is cut off by the full cutter 33. The cut tape piece Ta is ejected to the outside from the printing-tape ejecting slot 18.

The process tape T is wound into a roll and accommodated in the cartridge casing 25. Furthermore, there are provided a plurality of types of the process tapes T, each differing in a tape width and a material. The cartridge casing C has a plurality of small detection holes (not shown) formed on the rear surface thereof, and the tape discriminating sensor 23 detects the plurality of detection holes to discriminate the type of the process tape T. In particular, there are provided, as the process tape T, an ink-character-dedicated tape T1 for an ink-character printing and an ink-character/braille-character tape T2 adapted for an ink-character printing and a braille embossing. The ink-character-dedicated tape T1 is composed of a recording tape Tr made of PET (polyethylene terephthalate), the rear surface of which is coated with an adhesive agent layer, and of a peeling tape Tp1 made of a quality paper or the like which is affixed to the recording tape Tr by the adhesive agent layer. On the other hand, the ink-character/braille-character tape T2 is composed of the recording tape Tr having the same structure (although the thickness is different) as that of the ink-character-dedicated tape T1, and of a peeling tape Tp2 made of PET the same as that of the recording tape Tr.

This is because the peeling tape Tp2 of the ink-character/braille-character tape T2 is made of PET which has a smaller shock absorption ability than that of the peeling tape Tp1 of the ink-character-dedicated tape T1 and is never broken by the embossing, thereby making it possible to fully transmit an embossing force by embossing pins 48 (see FIG. 3B) to the recording tape Tr and prevent the generation of dust. Accordingly, the ink-character/braille-character tape T2 is more expensive than the ink-character-dedicated tape T1. Note that the ink-character-dedicated tape T1 and the ink-character/braille-character tape T2 are wound with the recording tape Tr and the peeling tape Tp (Tp1, Tp2) placed on the outside and the inside thereof, respectively, and accommodated in the cartridge casing 25.

Figure 3A:
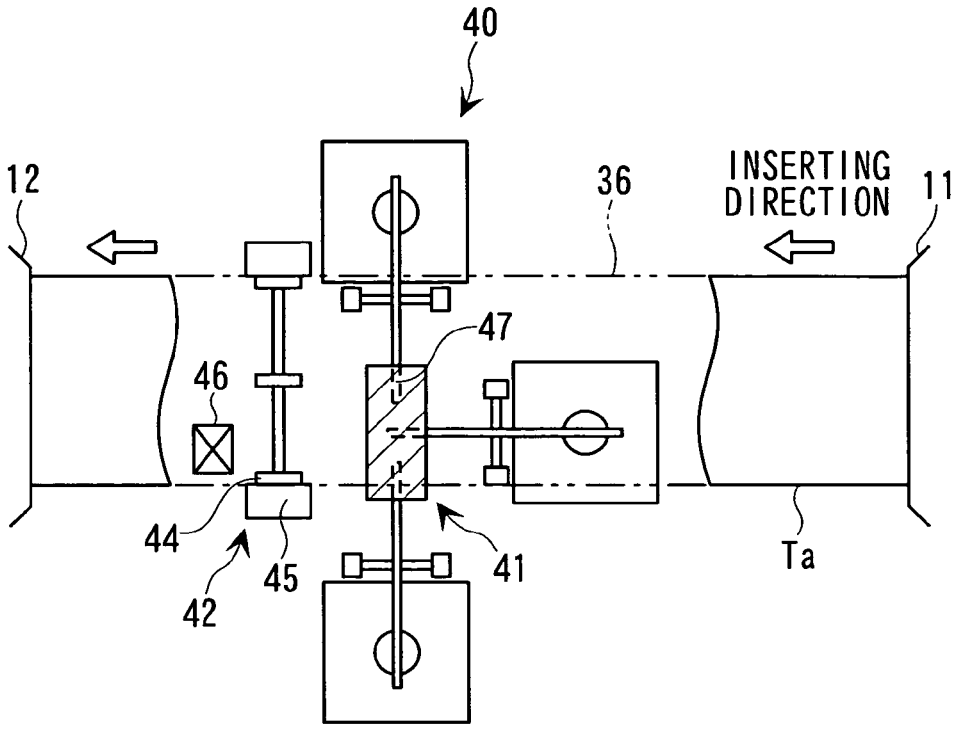
FIGS. 3A and 3B show a plan view and a cross-sectional view of an embossing unit, respectively.

As shown in FIG. 3A, the embossing assembly 40 faces on a tape traveling path 36 linearly connecting the embossing-tape inserting section 11 and the embossing-tape ejecting section 12 and has an embossing unit 41 (braille embossing device) and a tape feeding unit 42. The embossing unit 41 performs a braille embossing and is disposed biased to the half area on the cartridge mounting section 6 side in the width direction of the tape traveling path 36, and the tape feeding unit 42 feeds the tape piece Ta manually inserted from the embossing-tape inserting section 11 to the embossing-tape ejecting section 12.

The tape feeding unit 42 has feeding rollers 44 which are rotated to feed the tape piece Ta, roller-shaft supporting section 45 which pivotally supports the feeding rollers 44, a reversely rotatable embossing-feeding motor 43 (see FIG. 4) which rotates the feeding rollers 44, a power transmitting mechanism (not shown) which transmits the power of the embossing-feeding motor 43 to the feeding rollers 44, and a tip-end detecting mechanism 46 which detects the tip end of the tape piece Ta to be fed. In accordance with the driving of the embossing-feeding motor 43, the feeding rollers 44 are rotated through the power transmitting mechanism to feed the tape piece Ta. The tip-end detecting mechanism 46 detects the tip end of the tape piece Ta fed, as a result of which the embossing unit 41 starts performing a braille embossing.

Figure 3B:
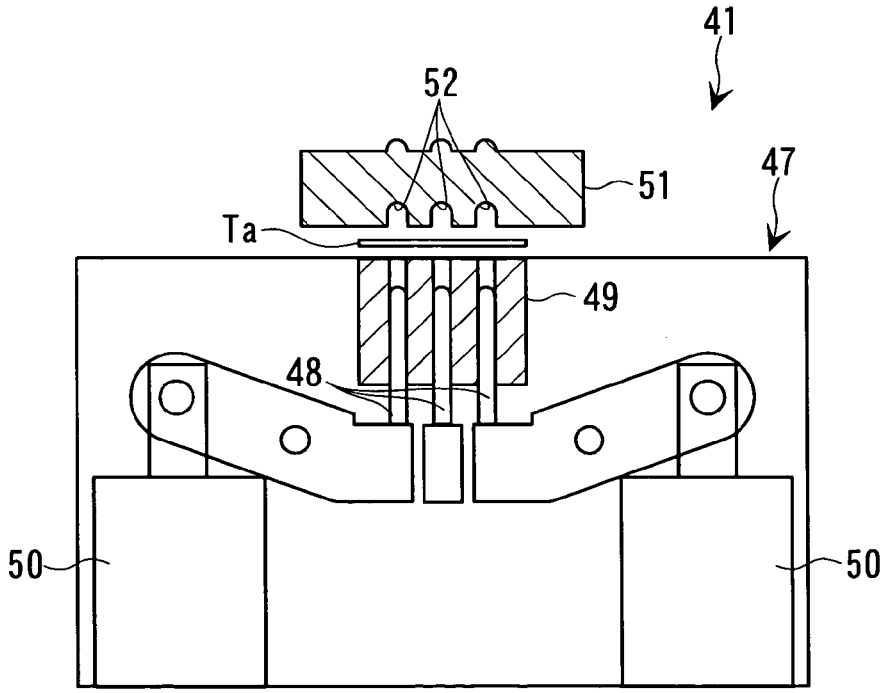

Referring to FIG. 3B, the embossing unit 41 is disposed on the upstream side in the tape-feeding direction relative to the feeding rollers 47 and composed of an embossing section 47 provided on the lower side of the inserted tape piece Ta and an embossing receiving section 51 provided at a position opposite to the embossing section 47. The embossing section 47 has three embossing pins 48 arranged to correspond to three vertically-aligned embossing salient of the six embossing salient constituting a braille character (braille character represented by six points), an embossing guide block 49 which guides the embossing movement of the three embossing pins 48 back and forth, and three solenoids 50 as a driving source. The embossing receiving section 51 has three receiving grooves 52 formed therein corresponding to the three embossing pins 48. While the tape piece Ta is fed by the tape feeding unit 42, the three embossing pins 48 are selectively jumped into the receiving grooves 52 by the three solenoids 50 as a driving source to perform an embossing operation. As a result, the tape piece Ta has an embossing salient made of the so-called six-point braille character formed thereon.

Figure 4:
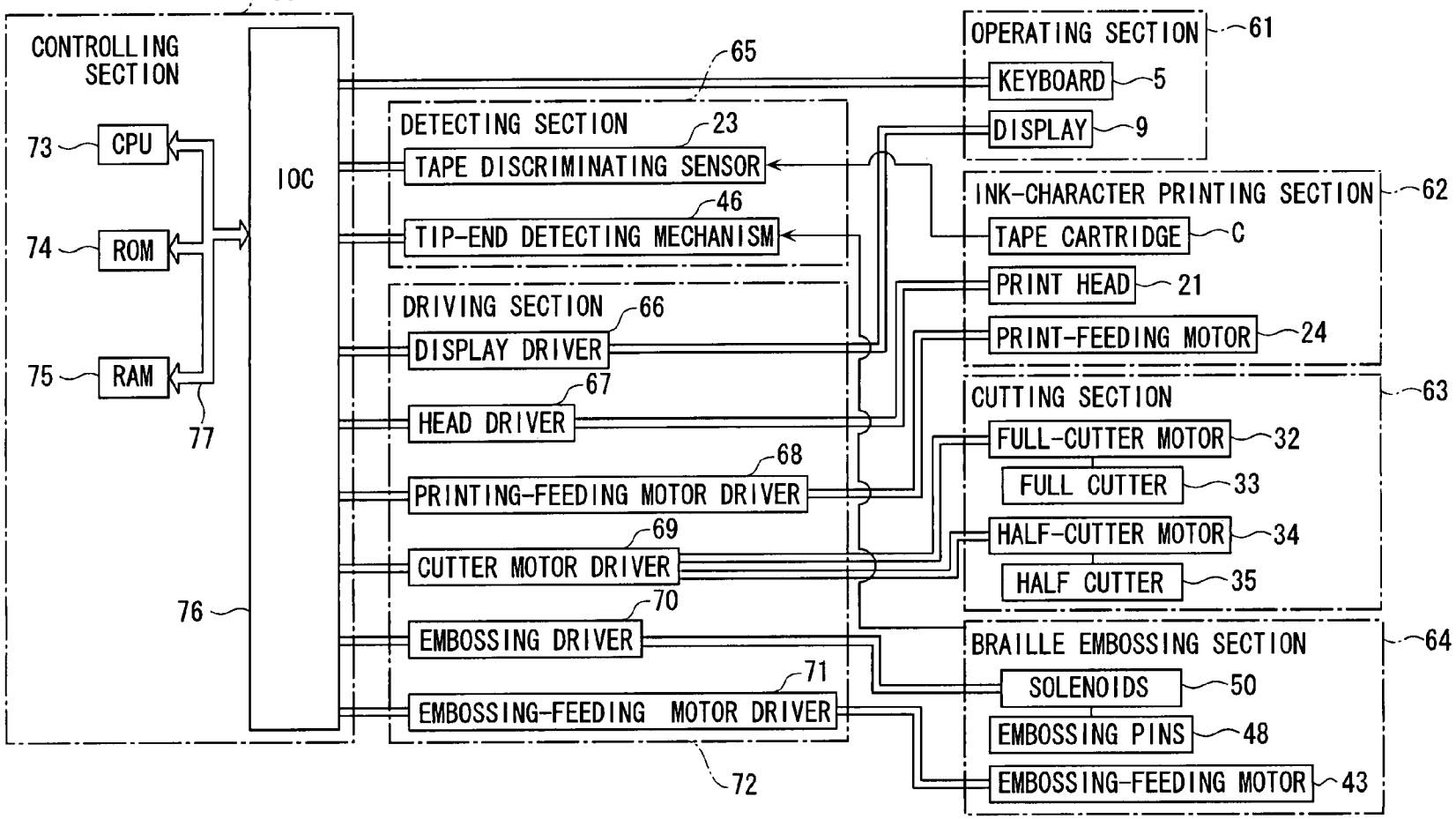
FIG. 4 shows a control block diagram of the label forming apparatus.

Referring next to FIG. 4, description will be made about a configuration of a control system of the label forming apparatus 1. The label forming apparatus 1 is composed of an operating section 61, the ink-character printing section 62, and a cutting section 63. The operating section 6 has the keyboard 5 and the display 9 and serves as a user interface by which the user inputs character information and displays various information. The ink-character printing section 62 has the tape cartridge C, the print head 21, and the print-feeding motor 24 and prints ink-character data on the process tape T based on inputted character information as the process tape T and the ink ribbon R are fed. The cutting section 63 has the full cutter 33, the half cutter 35, a full-cutter motor 32, and a half-cutter motor 34 and performs a full-cutting operation and a half-cutting operation on the printed process tape T.

Furthermore, the label forming apparatus 1 is composed of a braille embossing section 64, a detecting section 65, a driving section 72, and a controlling section 60. The braille embossing section 64 has the solenoids 50, embossing pins 48, and an embossing-feeding motor 43 and embosses braille characters of braille data based on character information on the tape piece Ta during transportation. The detecting section 65 has various sensors such as the tape discriminating sensor 23 and the tip-end detecting mechanism 46 and performs various detections. The driving section 72 has a display driver 66, a head driver 67, a printing-feeding motor driver 68, a cutter motor driver 69, an embossing driver 70, and the embossing-feeding motor driver 71 and drives each section. The controlling section 60 is connected to each section and controls the entire label forming apparatus 1.

The controlling section 60 has a CPU 73, a ROM 74, a RAM 75, and an IOC 76 (Input Output Controller), all of which are connected to one another through an internal bus 77. The CPU 73 inputs various signals and data from each of the sections in the label forming apparatus 1 through the IOC 76 in accordance with control programs of the ROM 74. The CPU 73 processes various data of the RAM 75 based on the inputted various signals and data and outputs the various signals and data to each of the sections in the label forming apparatus 1 through the IOC 76, to thereby control an ink-character printing process and a braille embossing process.

This controlling operation makes it possible to perform various operations on the process tape T. It is, of course, possible not only to print the process tape T with ink characters, cut it out into a tape piece Ta, and emboss it in braille to obtain a tape piece Ta with ink characters printed and braille characters embossed concurrently thereon, but also to obtain a tape piece Ta with only ink characters printed, but without braille-characters embossed thereon. It is further possible to obtain a tape piece Ta with only braille characters, but without the ink-characters printed thereon. Note that the processed tape piece Ta is to be affixed to an accompanying object to serve as a label for both ink characters and braille characters, a label for ink characters, or a label for braille characters, as the case may be.

Figure 5:
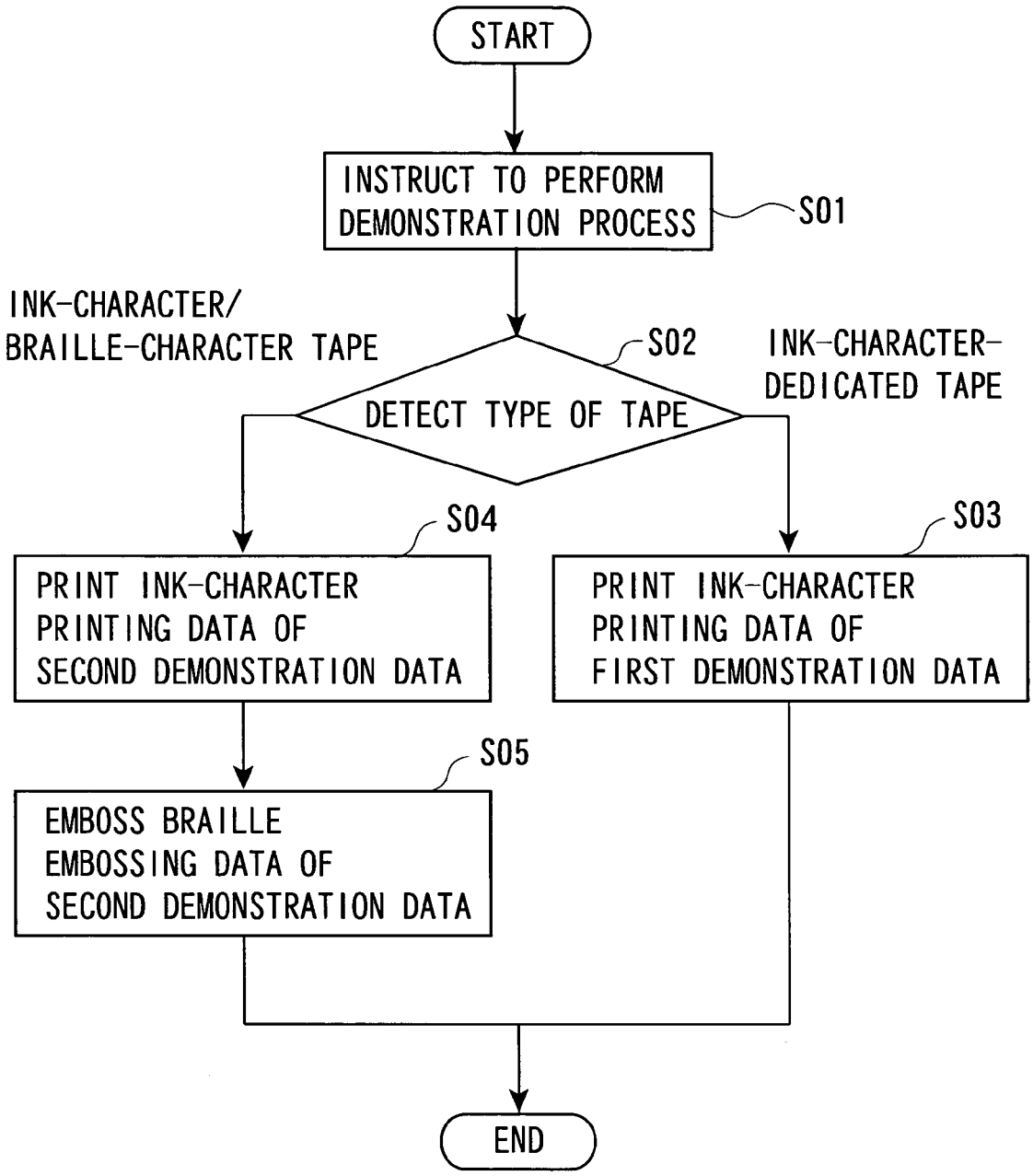
FIG. 5 shows a flow chart showing the flows of demonstration processes.

Meanwhile, the label forming apparatus 1 according to the present embodiment can perform a first demonstration process which conducts a demonstration for an ink-character printing and a second demonstration process which conducts a demonstration for a braille embossing. Description will now be made about the first and second demonstration processes in detail below. FIG. 5 shows a flow chart showing the flows of the first and second demonstration processes. As shown in FIG. 5, when the user performs a prescribed key operation to instruct a demonstration process (S01), the label forming apparatus 1 causes the tape discriminating sensor 23 to detect the type of the mounted process tape T (S02). When the process tape T belongs to the type of the ink-character-dedicated tape T1, the label forming apparatus 1 causes the ink-character printing section 62 to print ink-character printing data of first demonstration data stored in the ROM 74 on the ink-character-dedicated tape T1 (S03). On the other hand, when the process tape T belongs to the type of the ink-character/braille-character tape T2, the label forming apparatus 1 causes the ink-character printing section 62 to print ink-character printing data of second demonstration data stored in the ROM 74 on the ink-character/braille-character tape T2 (S04) and the braille embossing section 64 to further emboss braille characters of braille embossing data of the second demonstration data on the ink-character/braille-character tape T2.

Figure 6:
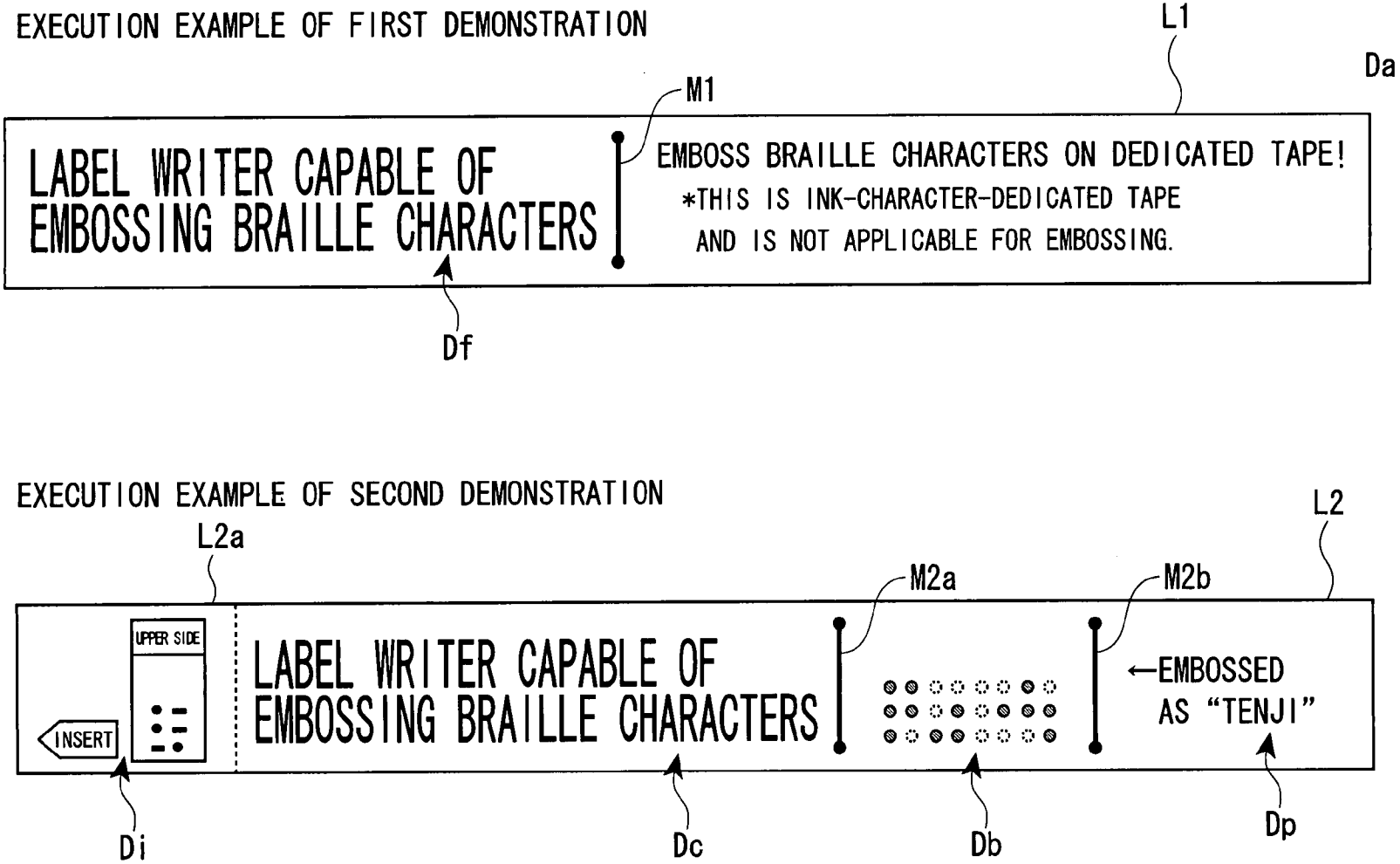
FIG. 6 shows execution examples of first and second demonstration processes.

Moreover, referring to FIG. 6, description will be made about a label L1 and a label L2 formed after the label forming apparatus 1 performs the first and second demonstration processes, respectively. As shown in FIG. 6, the label L1 has ink-character printing data of first demonstration data formed thereon in the first demonstration process. The ink-character printing data of the first demonstration data contains notice displaying data Da which notifies the user of the use of the label forming apparatus 1 and function displaying data Df which introduces functions of the label forming apparatus 1 to the user.

The notice displaying data Da indicates that different types of process tapes are used for an ink-character printing and a braille embossing, and the label L1 has printed thereon a character string of, for example, "EMBOSS BRAILLE CHARACTERS ON DEDICATED TAPE" and "*THIS IS INK-CHARACTER-DEDICATED TAPE AND NOT APPLICABLE FOR EMBOSSING." Accordingly, thanks to the warning of the notice displaying data Da, the user can easily realize these two points to the effect that the apparatus has the ink-character-dedicated tape T1 mounted thereon and a process tape (ink-character/braille-character tape T2) is required for a braille embossing. Regardless of the type of tape used, the notice displaying data Da may indicate various other warnings on the use of the apparatus.

Furthermore, the function displaying data Df represents the applicability of a braille embossing, and the label L1 has printed thereon a character string in bold type, for example, "LABEL WRITER CAPABLE OF EMBOSSING BRAILLE CHARACTERS." Accordingly, the function displaying data Df makes it possible for the user to easily realize that a braille embossing function is installed on the apparatus. In other words, it is possible to strongly appeal to users paying attention only to the apparatus feature of an ink-character printing function that they are allowed to perform a braille embossing with the label forming apparatus 1. It is further possible for the function displaying data Df to display the features of the label forming apparatus 1 such as various typefaces, symbols, fonts, braille translation function, or the like. Furthermore, a division mark M1 is printed between the notice displaying data Da and the function displaying data Df to divide them. The printing of the division mark M1 makes it possible for the user to easily read the printed notice displaying data Da and the function displaying data Df and enhances the appearance of the label L1. Note that the printing data of the division mark M1 is also contained in the ink-character printing data of the first demonstration data.

On the other hand, the label L2 has printed thereon ink-character printing data of second demonstration data in a second demonstration process and embossed thereon braille embossing data of the second demonstration data. The ink-character printing data of the second demonstration data contains ink-character translation data Dp which represents in ink characters the contents of the braille embossing data and commercial message data Dc which advertises respective functions of the label forming apparatus 1 to users. Furthermore, the braille embossing data of the second demonstration data is constituted of braille string data Db made up of a plurality of braille characters, and a braille string "TENJI," for example, is embossed on the label L2 based on the braille string data Db. Then, as the ink-character translation data Dp, a character string "←EMBOSSED AS "TENJI" is printed on the label L2. Accordingly, it is possible even for a user who has little knowledge about braille to easily understand the contents of the braille characters embossed in the second demonstration process. Note that the string of TENJI in alphabets is a transliteration of Japanese hiragana characters meaning braille, and the braille characters shown in FIG. 6 correspond to the Japanese hiragana characters of TENJI.

Furthermore, as the commercial message data Dc, the label L2 has printed thereon a character string in bold type, for example, "LABEL WRITER CAPABLE OF EMBOSSING BRAILLE CHARACTERS." This makes it possible to emphasize to users the braille embossing function installed on the label forming apparatus 1. In particular, the performance of this demonstration process at stores or the like can strongly appeal the braille embossing function to users and increased sales thereof can be expected. Moreover, the label L2 has printed thereon position marks M2*a* and M2*b* which mark a start position and an end position of the braille string data Db, respectively, whereby the user can easily recognize the embossing position. In the case of the configuration in which the user manually inserts the label L2 into the braille embossing section 64 (embossing-tape inserting section 11) after the ink-character printing process as in the present embodiment, the area of the braille string data Db is in blank immediately after the ink-character printing process. Accordingly, the printing of the ink-character translation data Dp and the position marks M2*a* and M2*b* notifies the user of the embossing position of the braille string data Db. As a result, there is no possibility that the user has a difficulty recognizing the braille embossing position.

After the ink-character printing process, the label forming apparatus 1 ejects the process tape T from the print-tape ejecting slot 18 and displays on the display 9 a message which prompts the user to insert the tape into the braille embossing section 64 (embossing-tape inserting section 11). Such a message display may be replaced with an indicator or an LED. Moreover, in addition to a start position and an end position of the braille string data Db, the position marks M2*a* and M2*b* may be of any shape such as those by which the embossing area of the braille string data Db is encircled.

Moreover, after the ink-character printing process in the second demonstration process, the half cutter 35 performs a half-cutting operation in which only the recording tape Tr (see FIG. 2) is cut off to form a margin L2*a* on the label L2. This margin L2 has printed thereon inserting direction data Di which indicates the inserting direction when the user manually inserts the label L2 into the braille embossing section 64 (embossing-tape inserting section 11) after the ink-character printing process. Accordingly, the user can insert the label L2 into the braille embossing section 64 (embossing-tape inserting section 11) using the inserting direction printed on the label L2 as an indicator. Note that the position marks M2*a* and M2*b* and the inserting direction data Di are contained in the ink-character printing data of the second demonstration data.

Furthermore, the label forming apparatus 1 of the present embodiment is capable of performing, in addition to the demonstration processes which conduct demonstrations for the ink-character printing and braille embossing processes, test processes which confirm whether or not the ink-character printing section 62 and the braille embossing section 64 normally operate, i.e., a first test process which tests the ink-character printing section 62 and a second test process which tests the braille embossing section 64. Similarly to the above-described demonstration processes, these test processes are performed based on first test data for the first test process and second test data for the second test process stored in the ROM 74. When the user performs a prescribed key operation to instruct the execution of the test processes, the label forming apparatus 1 starts the first test process or the second test process based on the discrimination result by the tape discriminating sensor 23.

Figure 7:
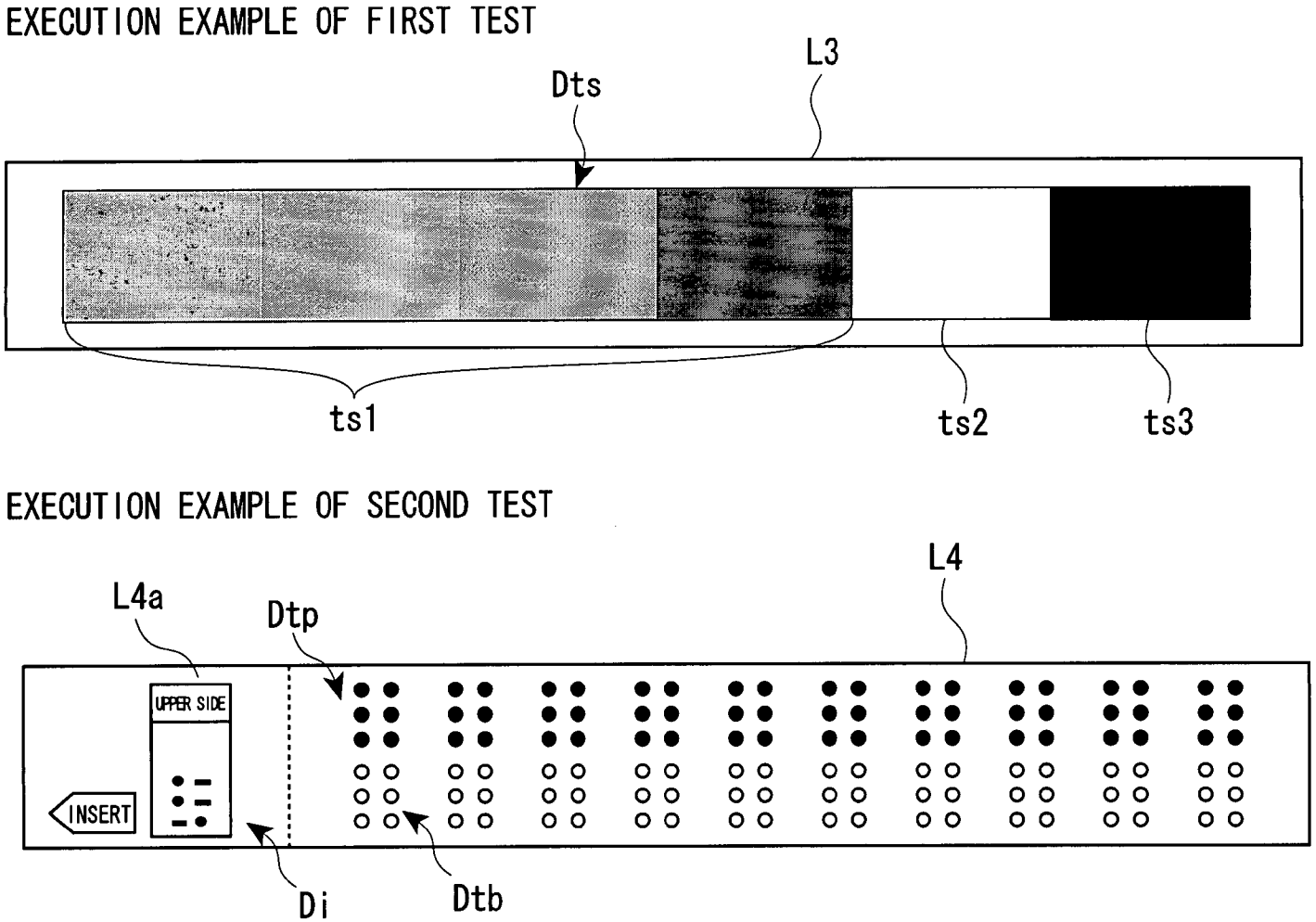
FIG. 7 shows execution examples of first and second test processes.

FIG. 7 shows labels L3 and L4 formed after the first and second test processes are performed, respectively. The label L3 has printed thereon, as the first test data, a rectangle Dts composed of a gray scale area ts1, a blank area ts2, and a solid-filled area ts3. Accordingly, the user checks the test result of the first test process to confirm whether or not a printing accuracy of the ink-character printing section 62 is correct. This first test process is particularly effective at the shipping of the label forming apparatus 1 or the like. Furthermore, text data including kanji characters and symbols may be printed as the first test data in addition to the rectangle Dts.

Furthermore, ink-character data Dtp which represents in ink characters a braille character "ME" (hiragana character), i.e., the image of a braille character, for which all the points in the six-point braille are used as embossing points, is repeatedly printed on the label L4 as the second test data, and braille data Dtb for the braille character is embossed thereon corresponding to the ink-character data Dtp. In other words, similarly to the second demonstration process, the ink-character printing section 62 prints the ink-character data Dtp and then the braille embossing section 64 embosses the braille data Dtb in the second test process. Furthermore, a half-cutting operation is also performed in the second test process, and inserting direction data Di which indicates the inserting direction for manually inserting the label L4 into the braille embossing section is printed on a margin L4*a* formed by the half-cutting operation.

Performing the second test process and confirming its test result allows the user to confirm whether or not the braille embossing has normally been operated by the braille embossing section 64 and approximately identify major causes of nonperformance based on the embossing result such as sequential not embossing, gradual reduction in embossing height, and aberration of embossing convex portions. Comparing the printed ink-character data Dtp with the embossed braille data Dtb allows the user to easily determine whether or not the braille embossing has correctly been operated by the braille embossing section 64 in the same pattern as that of the ink-character data Dtp.

In the present embodiment, the tape discriminating sensor 23 detects the type of the process tape T and performs the demonstration and test processes based on this detection result. Alternatively, the user may perform a prescribed key operation to select and instruct the execution of the first demonstration process (first test process) or the second demonstration process (second test process). At this time, if the process tape T suitable for the instructed process is not mounted on the label forming apparatus 1, it is desirable to execute error control by displaying an alert to the user. Furthermore, the ink-character printing process may be omitted in the second demonstration process (second test process) to perform only the braille embossing by the braille embossing section 64. The second demonstration process may be started at this time with the insertion of the process tape T (tape piece Ta) into the braille embossing section 64 (embossing-tape inserting section 11) as a trigger.

Moreover, the respective components (functions) of the label forming apparatus 1 shown in the foregoing examples can be provided as programs. They can be stored in a storage medium (not shown). The storage medium may be in the form of a CD-ROM, a flash ROM, a memory card (a compact flash (registered trademark), a smart media, a memory stick, etc.), a compact disk, a magnetic optical disk, a digital versatile disk, a flexible disk, or the like.

The invention is not limited to the embodiments described above, but various modifications on the apparatus configuration, process, etc. of the label forming apparatus 1 are possible without departing from the spirit and the scope of the invention.

What is claimed is:

1. A tape processing apparatus arranged to perform an ink-character printing and a braille embossing on a process tape, the apparatus comprising:

a first demonstration device which performs a first demonstration process based on first demonstration data for demonstration of the ink-character printing;

a second demonstration device which performs a second demonstration process based on second demonstration data for demonstration of the braille embossing; and a demonstration switching device which selectively switches between the first demonstration process and the second demonstration process, wherein the second demonstration data contains braille string data of a braille string composed of a plurality of braille characters as braille embossing data, as well as ink-character translation data converted from the braille string as ink-character printing data.

2. The tape processing apparatus according to claim 1, wherein an ink-character-dedicated tape for the ink-character printing and an ink-character/braille-character tape adapted for the ink-character printing and the braille embossing are provided as a process tape, both being detachably mounted on the tape processing apparatus while accommodated in a cartridge, the tape processing apparatus further comprising a tape-type detecting device which detects a type of the mounted process tape through the cartridge, the demonstration switching device switching between the first demonstration process and the second demonstration process based on a detection result by the tape-type detecting device.

3. A program embodied on a computer-readable storage medium which causes a computer to function as each of the devices of the tape processing apparatus according to claim 1.

4. A tape processing apparatus arranged to perform an ink-character printing and a braille embossing on a process tape, the apparatus comprising:

a first demonstration device which performs a first demonstration process based on first demonstration data for demonstration of the ink-character printing;

a second demonstration device which performs a second demonstration process based on second demonstration data for demonstration of the braille embossing;

a demonstration switching device which selectively switches between the first demonstration process and the second demonstration process;

an ink-character testing device which performs a test printing for the ink-character printing;

a braille testing device which performs a test embossing for the braille embossing; and a test switching device which selectively switches between the test printing and the test embossing.

* * * * *